US005381942A

United States Patent [19]

Lin

[11] Patent Number: 5,381,942

[45] Date of Patent: Jan. 17, 1995

[54] ADHESIVE TAPE DISPENSER

[76] Inventor: Ju-Chen Lin, No. 195, Wen-Shin Rd., Sec. 3, Taichung, Taiwan, Prov. of China

[21] Appl. No.: 188,757

[22] Filed: Jan. 31, 1994

[51] Int. Cl.[6] ..... B26F 3/02; B32B 31/00

[52] U.S. Cl. ..... 225/56; 225/77; 225/82; 225/90; 156/523; 156/527; 156/577

[58] Field of Search ..... 225/56, 77, 79, 80, 225/82, 84, 85, 87, 90; 156/523, 526, 527, 574, 576, 577, 579

[56] References Cited

U.S. PATENT DOCUMENTS

| | | | |
|---|---|---|---|
| 1,063,787 | 6/1913 | Evans | 225/79 |
| 1,064,596 | 6/1913 | Bengston | 225/85 X |
| 1,774,480 | 8/1930 | McClintock | 225/85 X |
| 2,470,250 | 5/1949 | Kienle | 225/85 X |
| 3,187,968 | 6/1965 | Favre | 225/56 |
| 4,762,586 | 8/1988 | Wilkie | 156/527 |
| 5,013,390 | 5/1991 | Hermann | 156/577 |
| 5,236,540 | 8/1993 | Shi | 156/523 |

*Primary Examiner*—Eugenia Jones
*Attorney, Agent, or Firm*—Browdy and Neimark

[57] ABSTRACT

An improved adhesive tape dispenser is provided with a holding piece capable of being acted on by a spring to hold the adhesive tape securely to the surface of a rolling wheel so as to permit a user of the dispenser to locate easily the end of the adhesive tape. The dispenser is further provided with a pressing member capable of causing the holding piece to move away from the rolling wheel to release the adhesive tape at such time when the pressing member is pressed with a finger.

2 Claims, 2 Drawing Sheets

ADHESIVE TAPE DISPENSER

FIELD OF THE INVENTION

The present invention relates generally to an adhesive tape dispenser, and more particularly to an improved adhesive tape dispenser capable of holding the adhesive tape in place when not in use.

BACKGROUND OF THE INVENTION

As shown in FIG. 1, an adhesive tape dispenser 10 of the prior art comprises a housing 11 provided at the front end thereof with a cutter 12. Located under the rear end of the housing 11 is a reel 13 on which an adhesive tape roll 20 is wound. The reel 13 is shielded by a protective cover 14, which can be lifted. Located at the front end of the housing 11 and under the cutter 12 are a rolling wheel 15 and two braking wheels 16. In operation, the operator uses fingers of his or her one hand to hold the through hole 17 of the reel 13 and his or her palm to hold the protective cover 14. After the front end 22 of the adhesive tape 21 has been pulled out, the adhesive tape 21 is cut by the cutter 12. The front end 22 of the adhesive tape 21 drops subsequently on the two braking wheels 16 so as to be caught easily by the user in the subsequent uses of the adhesive tape 21.

The front end 22 of the adhesive tape 21 is allowed to fall gently on the braking wheels 16 without a means to hold the front end 22 in place. As a result, it is very likely that the front end 22 of the adhesive tape 21 can be caused accidentally to become detached from the braking wheels 16, thereby causing the front end 22 to become adhered to the adhesive tape roll 20. The tape 21 is so thin and transparent that the front end 22 can not be easily located on the tape roll 20.

SUMMARY OF THE INVENTION

It is therefore the primary objective of the present invention to provide an adhesive tape dispenser with a means capable of preventing the front end of an adhesive tape from becoming detached from the braking wheels of the dispenser so as to facilitate the subsequent dispensing of the tape.

Another objective of the present invention is to provide an adhesive tape dispenser, which is simple in construction and can be therefore manufactured easily and economically.

The foregoing objectives of the present invention are attained by an adhesive tape dispenser, which is provided with a holding piece parallel to an adhesive tape roller. The adhesive tape is held between the surface of the tape roller and the holding piece. The dispenser is further provided with a pressing member capable of causing the holding piece to disengage the surface of the tape roller and the adhesive tape so as to permit the adhesive tape to be pulled out. The holding piece can keep the adhesive tape in place when the tape dispenser is not in use.

DETAILED DESCRIPTION OF THE INVENTION

Figure 1:
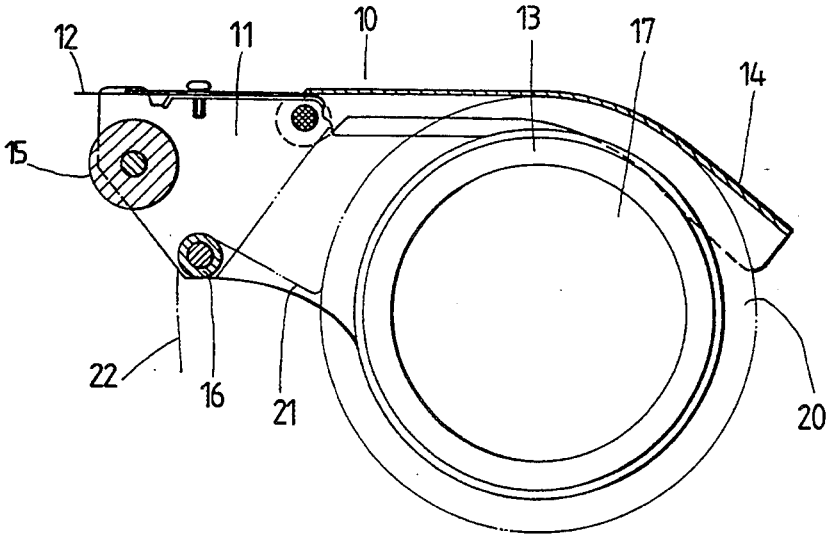
FIG.1 PRIOR ART
FIG. 1 shows a schematic view of an adhesive tape dispenser of the prior art.
Figure 2:
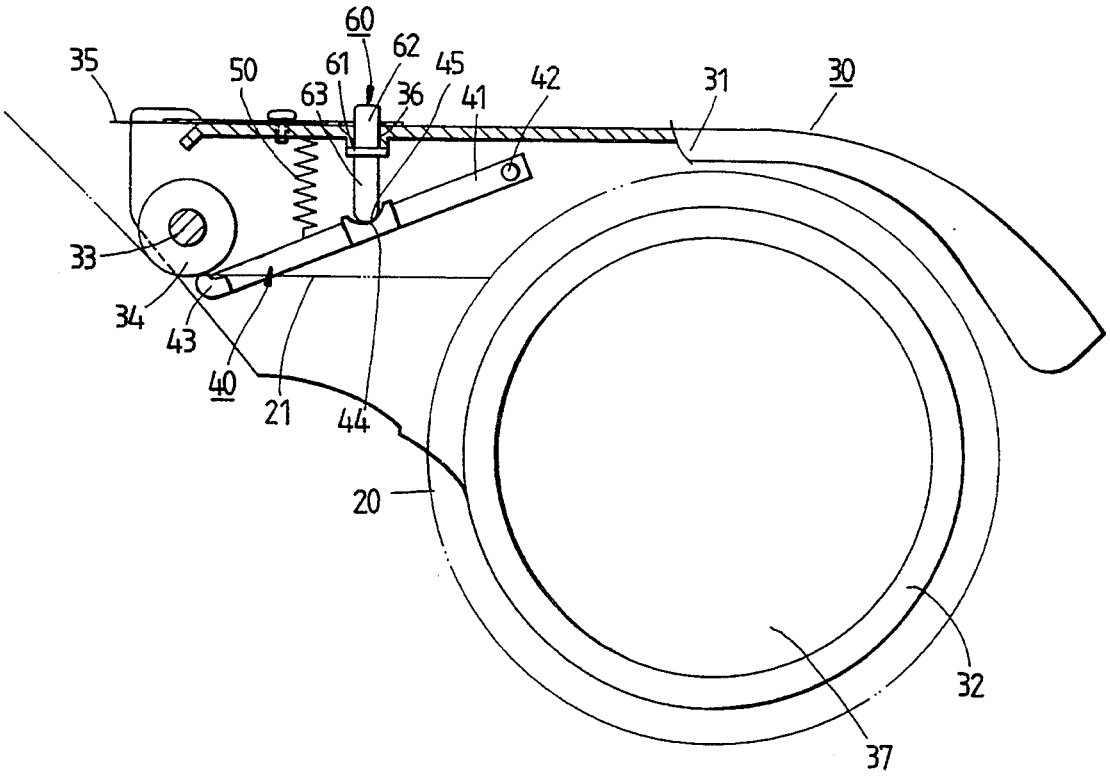
FIG. 2 shows a side schematic view of an adhesive tape dispenser embodied in the present invention.
Figure 3:
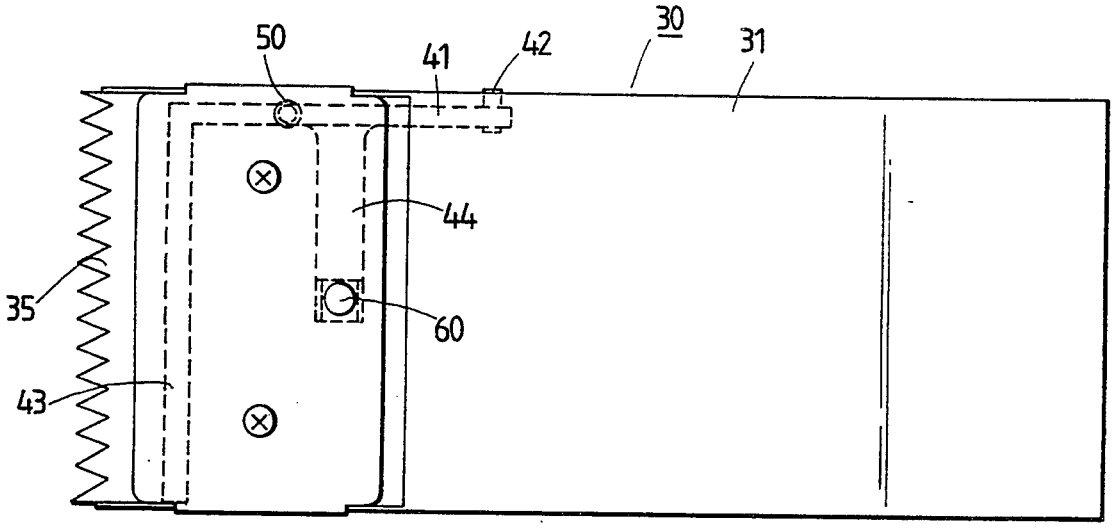
FIG. 3 is a top plan view of the adhesive tape dispenser as shown in FIG. 2, showing the main component parts in dotted lines.
Figure 4:
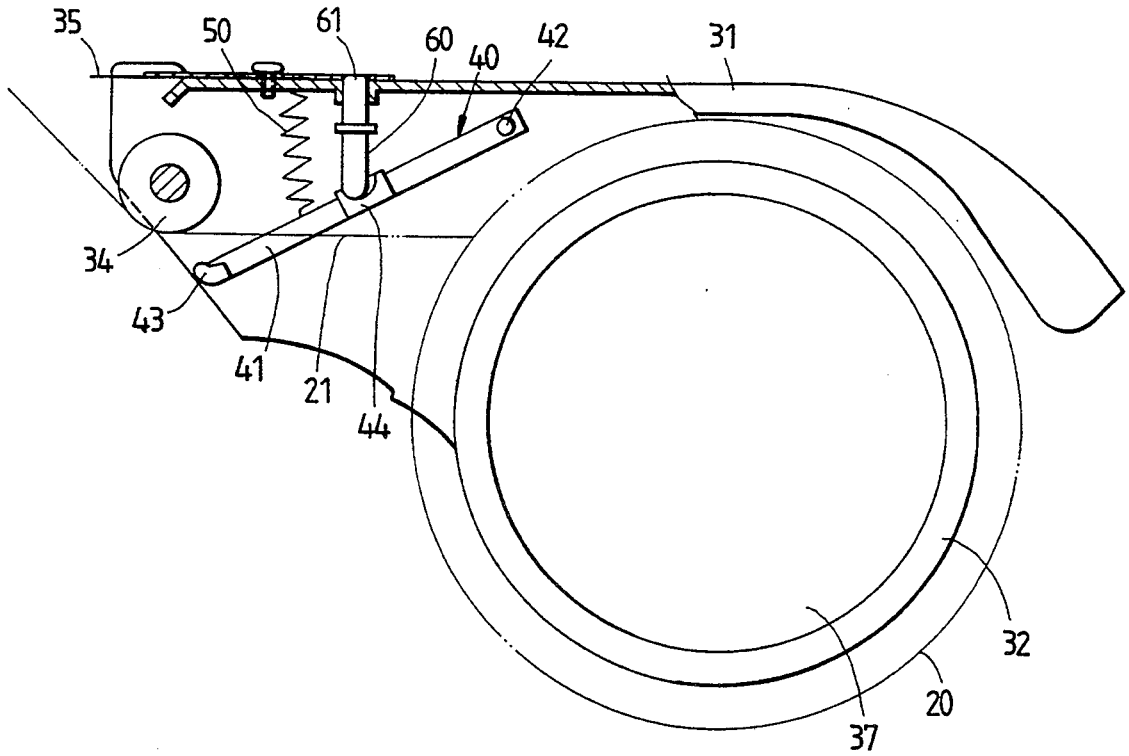
FIG. 4 shows a schematic view of the adhesive tape dispenser in use, according to the present invention.

Referring to FIGS. 2–4, an adhesive tape dispenser 30 of the present invention is shown to comprise a housing 31 provided with a reel 32 on which an adhesive tape roll 20 is wound. The housing 31 is provided at the front end thereof with a pivot 33 on which a rolling wheel 34 is mounted, and with a cutter 35. The housing 31 is still further provided therein with a movable member 40 of F-shaped construction and having a straight rod 41 pivoted at the rear end thereof to the housing 31 by means of a pin 42. Located at the front end of the straight rod 41 is a holding piece 43 parallel to the pivot 33 of the rolling wheel 34. The straight rod 41 is further provided centrally with a cross bar 44 parallel to the holding piece 43 and having at the top thereof a recess 45. A spring 50 has one end that is fastened to the straight rod 41 and another end that is secured to the housing 31. The spring 50 is intended to pull the movable member 40 to cause the holding piece 43 to make contact with the bottom of the rolling wheel 34. The housing 31 is further provided therein with a pressing member 60 having at the center thereof an arresting block 61. The pressing member 60 further has a top end 62 extending through a round hole 36 located at the center of the top surface of the housing 31. The pressing member 60 has a bottom end 63 located in the recess 45 of the cross bar 44. The movable member 40 can be caused to move downwards by exerting a downward pressure on the pressing member 60.

In combination, the top end 62 of the pressing member 60 is first inserted into the round hole 36 of the housing 31 before the rear end of the movable member 40 is pivoted by means of the pin 42. The spring 50 is then fastened respectively at both ends thereof with the straight rod 41 and the housing 31, thereby forcing the holding piece 43 to make contact with the bottom of the rolling wheel 34. The pressing member 60 is therefore caused to rise.

In operation, a user of the adhesive tape dispenser 30 of the present invention uses the palm of his or her one hand to hold the reel 32, which has a hole 37 large enough to accommodate a person's hand. The top end 62 of the pressing member 60 is pressed with one finger to cause the movable member 40 to swivel downwards on the pin 42 acting as an axis. As a result, the holding piece 43 is caused to move away from the bottom of the rolling wheel 34, thereby permitting the adhesive tape 21 to be pulled out, as shown in FIG. 4. As the finger is removed from the top end 62 of the pressing member 60, the movable member 40 is caused to move upwards by a pulling force of the spring 50, so as to cause the holding piece 43 to hold the adhesive tape 21 to the rolling wheel 34, as shown in FIG. 2. As a result, the end of the adhesive tape 21 can be easily located and pulled out at the time when the adhesive tape 21 is to be dispensed again.

The embodiment of the present invention described above is to be regarded in all respects as merely illustrative and not restrictive. Accordingly, the present invention may be embodied in other specific forms without deviating from the spirit thereof. For example, the movable member 40 and the pressing member 60 of the preferred embodiment described above may be of any shape while the spring 50 may be disposed at any other suitable location in the housing 31 as long as the movable member 40 is provided with a pulling force of the spring 50, by which the movable member 40 is caused to move upwards. The present invention is therefore to be limited only by the scope of the following appended claims.

What is claimed is:

1. An adhesive tape dispenser comprising a housing provided with a reel on which an adhesive tape roll is wound, said housing being further provided at a front end thereof with a rolling wheel mounted on pivot and with a cutter for cutting said adhesive tape; wherein said housing is further provided therein with a movable member fastened to said housing at one end thereof by a pin such that said movable member can rotate on said pin, said movable member having another end that is provided with a holding piece, a spring pressing said holding piece against said rolling wheel, said housing being still further provided with a pressing member having a top end extending upwards beyond a top surface of said housing and a bottom end engaged to said movable member, wherein normally said holding piece causes said spring to hold said adhesive tape securely against said rolling wheel, wherein when pressing said top end of said pressing member said holding piece rotates downwards moving said holding piece away from said rolling wheel to release said adhesive tape.

2. The adhesive tape dispenser of claim 1 wherein said movable member is provided centrally with a cross bar in contact with said bottom end of said pressing member.

* * * * *